US010040162B2

(12) United States Patent
Thielenhaus et al.

(10) Patent No.: US 10,040,162 B2
(45) Date of Patent: Aug. 7, 2018

(54) DEVICE FOR PRODUCING A CURVED SURFACE

(71) Applicant: Thielenhaus Technologies GmbH, Wuppertal (DE)

(72) Inventors: Johann Peter Thielenhaus, Duesseldorf (DE); Pete DiNardi, Livonia, MI (US); Klaus-Peter Fink, Wuppertal (DE)

(73) Assignee: Thielenhaus Technologies GmbH, Wuppertal (DE)

( * ) Notice: Subject to any disclaimer, the term of this patent is extended or adjusted under 35 U.S.C. 154(b) by 36 days.

(21) Appl. No.: 15/261,568

(22) Filed: Sep. 9, 2016

(65) Prior Publication Data

US 2018/0071882 A1 Mar. 15, 2018

(51) Int. Cl.
*B24B 19/26* (2006.01)
*B24B 27/00* (2006.01)

(52) U.S. Cl.
CPC ..... *B24B 19/26* (2013.01); *B24B 27/0023* (2013.01)

(58) Field of Classification Search
CPC ..... B24B 5/025; B24B 5/313; B24B 5/32; B24B 27/0023; B24B 27/0069; B24B 37/105
See application file for complete search history.

(56) References Cited

U.S. PATENT DOCUMENTS 1,518,971 A * 12/1924 Edwards ..... B24B 5/025 29/DIG. 102
1,833,329 A * 11/1931 Packer ..... B24B 5/025 29/33 J
2,050,422 A * 8/1936 Dalkowitz ..... B24B 5/025 451/221
2,194,780 A * 3/1940 Andersen ..... B24B 13/0031 451/247
2,232,843 A * 2/1941 Drissner ..... B24B 39/02 29/37 R
2,447,454 A * 8/1948 Abbott ..... B24B 5/025 451/247
3,739,530 A * 6/1973 Beauchet ..... B24B 5/26 451/292

(Continued)

*Primary Examiner* — Timothy V Eley
(74) *Attorney, Agent, or Firm* — Johnson, Marcou & Isaacs, LLC; Jennifer S. Stachniak

(57) ABSTRACT

A device for producing a curved surface (2) of a work piece (1) includes a tool (3) and a tool holder for receiving the tool (3), the tool holder being drivable for rotation about a tool axis (4). At least one work piece holder accommodates a work piece (1). The work piece holder is drivable for rotation about a work piece axis (5). The tool axis (4) and the work piece axis (5) are positionable at an angle relative to one another. The tool axis (4) and the work piece axis (5) are positionable at an angle relative to one another. A work piece holder support (6) receives a plurality of work piece holders, the work piece holders being rotatably drivable relative to the work piece holder support (6). The work piece holder support (6) is rotatably drivable about a work piece holder support axis (7), so that based on superposed rotations of work piece holders and work piece holder support (6) and the rotating tool, the surface (2) of each work piece (1) is curved after end machining, depending on an inclination angle.

10 Claims, 2 Drawing Sheets

(56) References Cited

U.S. PATENT DOCUMENTS

| | | | | | |
|---|---|---|---|---|---|
| 3,771,509 | A * | 11/1973 | Murchie | B24B 5/025 | 125/11.03 |
| 4,829,716 | A * | 5/1989 | Ueda | B24B 13/0031 | 279/158 |
| 5,299,394 | A * | 4/1994 | Surdacki | B24B 27/0069 | 451/194 |
| 5,951,376 | A * | 9/1999 | Mandler | B24B 13/0031 | 451/178 |
| 6,685,542 | B2 * | 2/2004 | Mori | B24B 7/04 | 451/287 |
| 7,765,903 | B2 * | 8/2010 | Schorcht | B24B 13/00 | 82/1.11 |
| 2013/0221589 | A1 * | 8/2013 | Mandler | B24B 13/0037 | 269/21 |

* cited by examiner

DEVICE FOR PRODUCING A CURVED SURFACE

BACKGROUND OF THE INVENTION

The present invention relates to a device for producing a slightly curved surface of a work piece, with a tool holder for receiving a tool, whereby the tool holder is drivable for rotation about a tool axis, and with at least one work piece holder for receiving a work piece, whereby the work piece holder is rotatable about a work piece axis, and whereby the device is designed, such that the tool axis and the work piece axis are angularly adjustable with an inclination angle relative to one another. The invention relates in particular to the end machining of a surface, which is known also as micro-finishing or super-finishing.

For end machining of planar surfaces, it is know that the rotational axis of the planar finishing piece is oriented parallel to the rotational axis of the rotating work piece. Based on the tolerances, the end-machined surfaces are generally not completely planar, whereby the end-machined surfaces, in addition to a roughness, can have a slightly concave or slightly convex curving. For any application, it is generally necessary that the tolerance with regard to the curving occurs only in one direction. That is, either exclusively slightly convex or exclusively slightly concave surfaces should be produced.

DE 39 28 514 C2 describes a device with the features described above, in which the tool axis is positioned at an angle or inclined relative to the tool axis. By means of relative angular adjustment of the tool axis and the work piece axis, depending on the direction of the angular adjustment, a concave or a convex curving of the surface is produced. With this type of device, it generally is only possible to precisely machine a work piece with a tool.

SUMMARY OF THE INVENTION

An object of the present invention, therefore, is to provide a device with which multiple work pieces are machined by means of one tool, whereby the machined surface of each work piece is either curved concavely or convexly.

This object is resolved, in particular, by a device with the above-noted features, whereby a work piece holder support is provided for receiving a plurality (at least two, preferably at least four) work piece holders that are rotatable driven relative to the work piece holder support, whereby the work piece holder support is drivable rotatably about a work piece holder support axis, so that based on the superposed rotations of the work piece holders and work piece holder support, as well as the rotating work piece, the surface of each work piece is slightly curved after end machining depending on the inclination angle.

Since the work piece holder rotates by means of at least one drive relative to the work piece holder support, respectively, and since the work piece holder support itself rotates, it is possible to machine the plurality of work pieces simultaneously by means of only one rotating tool, such that the end machined surfaces of all work pieces either have a slightly concave curvature or a slightly convex curvature.

The tool holder is coupled with a tool drive, by means of which the rotational speed of the tool can be adjusted. In addition, the work piece holder support is connected with a work piece holder support drive, with which the rotational speed of the work piece holder support can be adjusted. The multiple work piece holders, in turn, are either coupled, respectively with an individual drive or with a common drive. It also can be provided that the work piece holders are coupled with the work piece holder support drive, also by activating a drive.

By the terms work piece axis, tool axis, and work piece holder support axis, depending on the circumstances, imaginary axes are intended, about which the work piece, the tool or the work piece holder support rotate during the end machining. The imaginary axes are, in particular, a straight-line extension of the shafts of the corresponding drives. With an inclined or angular position of two axes relative to one another, it is intended, in particular, that at least the virtual extensions of the rotational axes intersect one another.

In a first embodiment, it is provided that the work piece axes of the plurality of work piece holders are oriented parallel to the work piece holder support axis, whereby the tool axis is positionable at an angle or inclined relative to the work piece holder support axis. Thus, the tool axis also intersects, respectively a work piece axis of a work piece holder at least in a respective rotational position of the work piece holder support. Based on the rotating work piece holder support, the work pieces are repeatedly moved under the angularly positioned, rotating tool, in particular, successively, whereby during contact of the tool on the corresponding surface, the finishing machining of the surface takes place. Since, in addition, each work piece holder rotates relative to the work piece holder support, a rotationally symmetrical machining of the surface of each work piece takes place. With this embodiment, the inclination angle can be changed by pivoting of the work piece holder relative to the work piece holder support.

In this connection, it is particular preferable if the work piece holder is arranged to be radially outwardly offset relative to the tool holder support axis.

In one embodiment, it can be provided that the work piece axes of the plurality of work piece holders are positionable at an angle or incline to the work piece holder support axis, whereby the tool axis is oriented parallel to the work piece holder support axis. With this embodiment, the inclination angle between the tool and the individual work piece holders can therefore be adjusted by pivoting of the work piece holder about an axis in a plane, which his orthogonal to the tool axis and the work piece holder support axis. In this embodiment, if the tool axis is arranged flush with the work piece holder support axis, the surface to be machined continuously contacts the tool.

In particular, the work piece holders are pivotable relative to the inclined position, respectively, about an axis that runs tangentially to an imaginary circumference, whose center point is penetrated by the work piece holder support axis. The work piece holders can be pivoted with the surface to be machined back to the center point of the work piece holder support or pivoted away with the machined surface from the center point of the work piece holder support. By means of pivoting outwardly, in particular, a convex surface curvature can be produced, while by means of a pivoting inwardly, a concave surface curvature of the work piece can be produced.

Preferably, the plurality of work piece holders is arranged in a circular configuration in the work piece holder support. With a parallel orientation of the work piece axes of the work piece holder to the work piece holder support axis, the work piece axes therefore lie in a circular, whose center point is penetrated by the work piece holder support axis. The plurality of work piece holders, however, also can be arranged such that they form multiple circular arrangements.

In particular, if the work piece holder can bee pivoted to the work piece holder support, in this connection, in particular for producing slightly concave curvatures, it can be provided that an outer diameter of the tool is selected so that an outer edge of the tool extends additionally through the center points of the surfaces to be machined that are defined by the work piece axes.

It is conceivable in principle that each work piece holder is rotatably driven with an automatic drive relative to the work piece holder support. Preferably, however, the plurality of work piece holders is drivable via a common drive, for example by interconnection of a belt drive. This common drive can be coupled additionally with the drive of the work piece holder support. In this case, the synchronization of multiple, different drives is eliminated.

In order to adjust or eliminate cross grinding, the work piece holders are mounted, respectively, to be pivotable about an axis lying transverse to the work piece holder support axis and are fixable in a pivoted or swiveled position. The work piece holder, therefore, can be angled into or against the rotational direction of the work piece holder support.

The tool, in particular, is a finishing tool with geometrically indefinite edges and preferably a cup wheel. The respective multiple work piece holders are formed, in particular, by a spindle.

BRIEF DESCRIPTION OF THE DRAWINGS

The present invention as well as the technical field will be described with reference to the accompanying figures. In the figures.

DETAILED DESCRIPTION OF THE PREFERRED EMBODIMENTS

Figure 1:
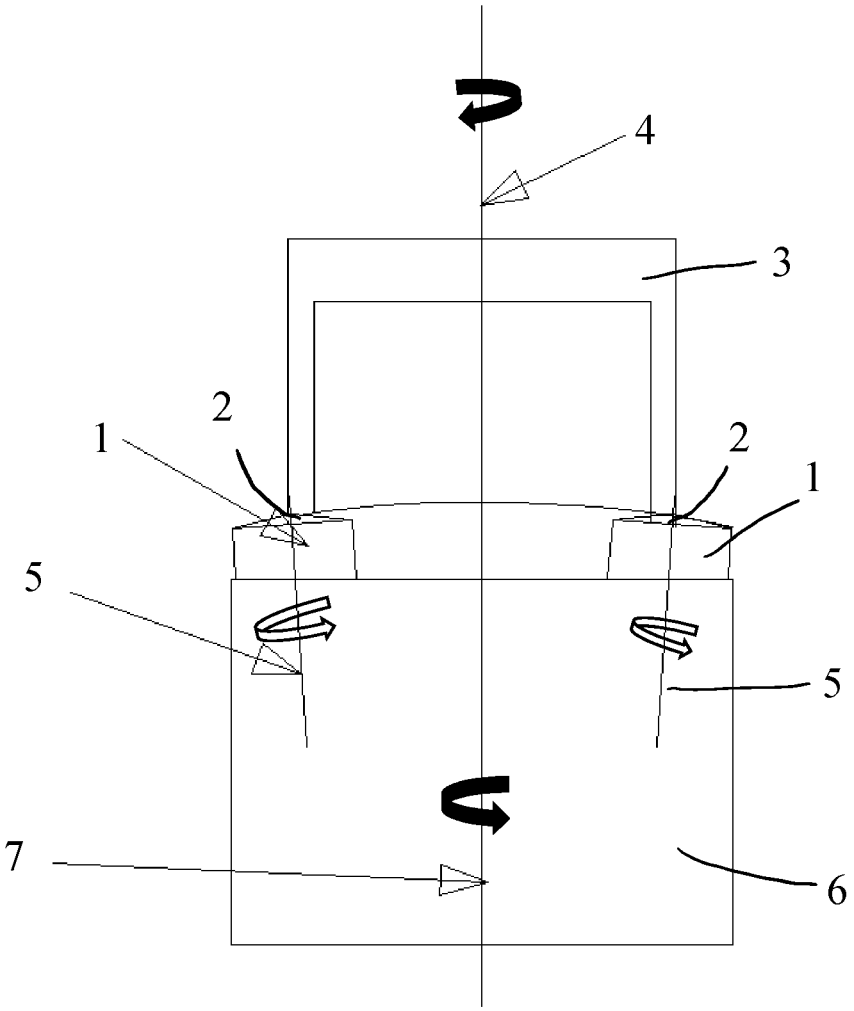
FIG. 1 shows a first embodiment of a finishing device for machining multiple work pieces.

FIG. 1 shows a work piece holder support 6, which is drivable by means of a drive (not shown) about a work piece holder support axis. In the work piece holder support 6, multiple work pieces 1 are rotatably mounted by means of respective work piece holders, whereby the work piece holders are drivable, respectively, rotatably about a work piece axis 5. The work piece holders can be coupled with one another, for example, by means of a belt drive. The work piece holders are pivoted with the surface 2 to be machined away from the work piece holder support axis 7 and fixed into the pivoted position.

The device further includes a tool 3 formed as a cup wheel, which can be driven by means of a drive (not shown) to a rotation about the tool axis 4. The tool axis 4 is oriented parallel to the work piece holder support axis 7.

Based on the relative drive of the work piece 1 to the rotating work piece holder 6, the surface 2 of the work piece 1 obtains a slightly convex curvature by machining with the rotating tool 3.

If the work pieces 1 were pivoted with the surfaces 2 in the direction of the work piece holder support axis 7 and the tool 3 were to contact with its outer edge the center points of the surfaces 2 to be machined, then a slightly concave surface would be produced based on the relative rotation of the work piece 1 to the work piece holder support 6.

Figure 2:
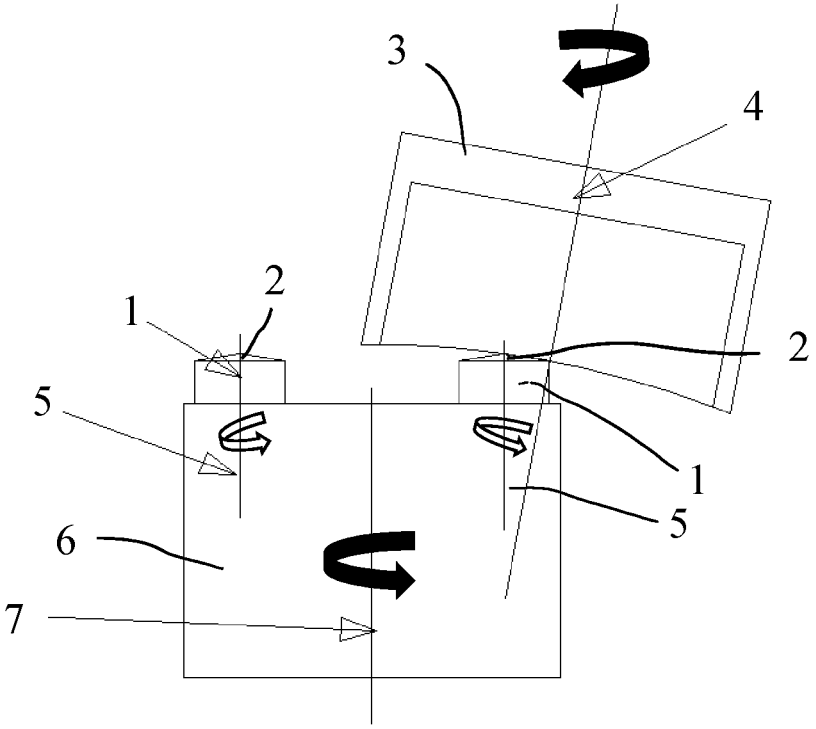
FIG. 2 shows a further embodiment of a finishing device for machining multiple work pieces.

The embodiment shown in FIG. 2 differs from the embodiment shown in FIG. 1, in that the work piece axes 5 are oriented parallel to the to the work piece holder support axis 7 and the tool axis 4 is positioned at an angle or inclined to the work piece holder support axis 7. In this regard, the inclination angle can be changed by pivoting the tool 3. The tool axis 4 intersects a work piece axis 5 of a work piece 1 at least in one respective rotational position of the work piece holder support 6.

In order to produce a concave surface 2 with this embodiment, the tool 3 must be arranged, such that a radially inner or radially outer circumferential edge of the tool 3, with reference to the work piece holder support axis 6, runs through the center point of the surface 2 to be machined, whereby the tool 3 must be angled inwardly or outwardly.

The features of the subject matter of this invention set forth in the above description, the patent claims, the abstract and the drawings can be used individually and in any desired combination for the realization of the invention in its various embodiments.

The present invention is, of course, in no way restricted to the specific disclosure of the specification and drawings, but also encompasses any modifications within the scope of the appended claims.

REFERENCE NUMERAL LIST

1 work piece
2 surface
3 tool
4 tool axis
5 work piece axis
6 work piece holder support
7 work piece holder support axis

We claim:

1. A device for producing a curved surface (2) of a work piece (1), comprising:

a tool holder for receiving a tool (3), wherein the tool holder is drivable for rotation about a tool axis (4);

at least one work piece holder for receiving a work piece (1), wherein the work piece holder is drivable for rotation about a work piece axis (5), wherein the tool axis (4) of the tool holder is inclined with an inclination angle relative to the work piece axis (5) of the at least one work piece holder;

a work piece holder support (6) for receiving a plurality of work piece holders, wherein said work piece holders are rotatably drivable relative to the work piece holder support (6), wherein the work piece holder support (6) is rotatably drivable about a work piece holder support axis (7), so that due to superposed rotations of the work piece holders and the work piece holder support (6) and the tool during machining, a surface (2) of each work piece (1) is curved after end machining depending on the inclination angle.

2. The device according to claim 1, wherein the work piece axes (5) of the at least one work piece holder are oriented parallel to the work piece holder support axis (7) and wherein the tool axis (4) is positionable at an angle relative to the work piece holder support axis (7).

3. The device according to claim 2, wherein the tool holder is arranged radially outwardly offset relative to the work piece holder support axis (7).

4. The device according to claim 1, wherein the work piece axes (5) of the at least one work piece holder are positionable at an angle to the work piece holder support axis (7), and wherein the tool axis (4) is oriented parallel to the work piece holder support axis (7).

5. The device according to claim 4, wherein the at least one work piece holder is pivotable about an axis for inclination, wherein the axis runs tangential to an imaginary circumference, where a center point of said circumference is penetrated by the work piece holder support axis (7).

6. The device according to claim 4, wherein an outer diameter of the tool (3) is selected, such that an outer edge of the tool (3) contacts center points of the surface to be machined that are defined by the work piece axes (5).

7. The device according to claim 1, wherein the at least one work piece holder is arranged in a circulation formation in the work piece holder support (6).

8. The device according to claim 1, wherein the at least one work piece holder is drivable via a common drive.

9. The device according to claim 1, wherein the at least one work piece holder is pivotable about an axis transverse to the work piece holder support axis (7).

10. The device according to claim 1, wherein the tool (3) is a cup wheel and the at least one work piece holder is a spindle.

* * * * *